US010213644B2

(12) United States Patent
Xing

(10) Patent No.: US 10,213,644 B2
(45) Date of Patent: Feb. 26, 2019

(54) ELLIPTICAL TRAINER

(71) Applicant: OMA METAL INDUSTRIAL CO., LTD., Foshan (CN)

(72) Inventor: Kaibin Xing, Foshan (CN)

(73) Assignee: OMA METAL INDUSTRIAL CO., LTD., Foshan (CN)

( * ) Notice: Subject to any disclaimer, the term of this patent is extended or adjusted under 35 U.S.C. 154(b) by 26 days.

(21) Appl. No.: 15/610,544

(22) Filed: May 31, 2017

(65) Prior Publication Data

US 2018/0290014 A1 Oct. 11, 2018

(30) Foreign Application Priority Data

Apr. 10, 2017 (CN) ..... 2017 1 0228529
Apr. 10, 2017 (CN) ..... 2017 2 0367453 U

(51) Int. Cl.
*A63B 22/06* (2006.01)
*A63B 21/012* (2006.01)
(Continued)

(52) U.S. Cl.
CPC ..... *A63B 22/0664* (2013.01); *A63B 21/0052* (2013.01); *A63B 21/0125* (2013.01);
(Continued)

(58) Field of Classification Search
CPC combination set(s) only.
See application file for complete search history.

(56) References Cited

U.S. PATENT DOCUMENTS 5,305,648 A * 4/1994 Diekhans ..... F16H 61/662 73/862.191
5,711,404 A * 1/1998 Lee ..... A63B 21/0051 188/158
5,749,807 A * 5/1998 Webb ..... A63B 21/157 482/52
6,042,512 A * 3/2000 Eschenbach ..... A63B 22/001 482/52
6,165,107 A * 12/2000 Birrell ..... A63B 21/157 482/51
(Continued)

FOREIGN PATENT DOCUMENTS

EP 2208514 A2 7/2010

*Primary Examiner* — Loan H Thanh
*Assistant Examiner* — Shila Jalalzadeh Abyane
(74) *Attorney, Agent, or Firm* — Marshall A. Lerner; Marvin H. Kleinberg; Kleinberg & Lerner, LLP

(57) ABSTRACT

The invention relates to an elliptical trainer including: a frame having a first end and a second end; a rocker-rod mechanism hingedly connected to the first end of the frame; a pedal mechanism hingedly connected to the second end of the frame through a transmission mechanism; an adjustment mechanism including an adjustment table, one end of the adjustment table being rotatably connected to the frame, the pedal mechanism being slidably connected to the adjustment table, the adjustment mechanism adjusting the position of the pedal mechanism relative to the frame; and a link the two ends of which are connected to the rocker-rod mechanism and the pedal mechanism respectively so that the rocker-rod mechanism is linked with the pedal mechanism. Since the apparatus of the invention is provided with an adjustment mechanism which is rotatably connected to the frame and the pedal mechanism is slidably connected to the adjustment mechanism, an exercise experience that the user simulates climbing by means of the pedal mechanism can be improved by changing an elevation angle of the adjustment mechanism relative to the frame. In the apparatus of the invention,
(Continued)

a resistance adjustment mechanism is provided on a flywheel, the user can obtain more exercise experiences by increasing rotation resistance of the flywheel and a turntable.

9 Claims, 2 Drawing Sheets

(51) Int. Cl.

| | |
|---|---|
| ***A63B 21/22*** | (2006.01) |
| ***A63B 21/00*** | (2006.01) |
| ***A63B 22/00*** | (2006.01) |
| ***A63B 21/005*** | (2006.01) |
| ***A63B 24/00*** | (2006.01) |
| ***A63B 71/06*** | (2006.01) |
| ***A63B 23/04*** | (2006.01) |
| ***A63B 22/20*** | (2006.01) |

(52) U.S. Cl.

CPC ..... *A63B 21/154* (2013.01); *A63B 21/225* (2013.01); *A63B 21/4034* (2015.10); *A63B 21/4035* (2015.10); *A63B 22/001* (2013.01); *A63B 22/0015* (2013.01); *A63B 22/205* (2013.01); *A63B 23/0405* (2013.01); *A63B 24/0087* (2013.01); *A63B 71/0619* (2013.01); *A63B 21/005* (2013.01); *A63B 22/0046* (2013.01); *A63B 2022/067* (2013.01)

(56) References Cited

U.S. PATENT DOCUMENTS

| | | | | |
|---|---|---|---|---|
| 7,704,192 | B2 * | 4/2010 | Dyer | A63B 22/001 482/52 |
| 8,864,631 | B1 * | 10/2014 | Stearns | A63B 22/0664 482/51 |
| 2002/0072454 | A1 * | 6/2002 | Klein | A63B 22/0023 482/52 |
| 2005/0227824 | A1 | 10/2005 | Wu et al. | |
| 2006/0183605 | A1 | 8/2006 | Dyer | |
| 2008/0242516 | A1 * | 10/2008 | Lu | A63B 22/001 482/52 |
| 2010/0167877 | A1 * | 7/2010 | Grind | A63B 22/001 482/52 |
| 2011/0028277 | A1 * | 2/2011 | Merli | A63B 22/001 482/63 |
| 2012/0165160 | A1 | 6/2012 | Chen et al. | |
| 2013/0210585 | A1 * | 8/2013 | Arnold | A63B 21/0052 482/52 |

* cited by examiner

ELLIPTICAL TRAINER

FIELD

This application relates to the technical field of exercise equipment, and more particularly to an elliptical trainer.

BACKGROUND

Elliptical trainer is a recently emerging exercise fitness equipment, and generally refers to a variety of devices which can guide the left and right pedals to move along an elliptical trajectory or a trajectory in similar shape for the user to simulate leg movements such as walking, running, and stair climbing.

Most of the existing elliptical trainers have a fixed pedal trajectory. Although the user can change the movement load by adjusting resistance to the movement of the pedals, a fixed pedal trajectory usually means the form of leg movement of the user is immutable, which not only makes it impossible to choose the movement form according to the personal preference and choose the muscle parts that the user wants to exercise, but also makes the movement lack changes and be monotonous. Additionally, the movement resistance adjustment of the existing elliptical trainer is limited by the structure, leading to a limited adjustable resistance range and a poor user experience.

The above-mentioned information disclosed in the background is only intended to enhance the understanding of the background of the invention and therefore may contain information that is not the prior art known to those skilled in the art.

SUMMARY

In view of this, the embodiments of the present application provide an elliptical trainer to solve at least the problems existing in the prior art.

The technical solutions of the embodiments of the present application are implemented as following. According to an embodiment, it is provided an elliptical trainer including: a frame having a first end and a second end; a rocker-rod mechanism hingedly connected to the first end of the frame; a pedal mechanism hingedly connected to the second end of the frame through a transmission mechanism; an adjustment mechanism including an adjustment table, one end of the adjustment table being rotatably connected to the frame, the pedal mechanism being slidably connected to the adjustment table, the adjustment mechanism adjusting a position of the pedal mechanism relative to the frame; and a link the two ends of which are connected to the rocker-rod mechanism and the pedal mechanism respectively so that the rocker-rod mechanism is linked with the pedal mechanism.

In some embodiments, the other end of the adjustment table is connected to a lifting mechanism including a strut and a drive device for driving the strut to extend or retract, and one end of the strut is hingedly connected to the other end of the adjustment table for adjusting the slope of the adjustment table and the position of the pedal mechanism.

In some embodiments, a sliding slot is provided on the adjustment table.

In some embodiments, the pedal mechanism includes two support rods and two pedals provided on the two support rods respectively, one end of the support rod that is close to the pedal is slidably connected to the sliding slot, the other end of the support rod is connected to the transmission mechanism, and one end of the link is hingedly connected to the support rod.

In some embodiments, the transmission mechanism includes a turntable and a flywheel respectively rotatably connected to the second end of the frame, the rotation shaft of the flywheel is connected to the turntable through a belt, and the other end of the support rod is connected to the turntable.

In some embodiments, a resistance adjustment mechanism is provided on the flywheel for changing the rotation resistance of the flywheel.

In some embodiments, the resistance adjustment mechanism includes a clip board sleeved on the rotation shaft of the flywheel and rotatably connected to the rotation shaft, a tension pulley is provided on the clip board for controlling the rotation of the belt, and the clip board is connected to a drive device for driving the clip board to rotate.

In some embodiments, a plurality of limit slots are provided on the clip board, a plurality of limit protrusions are provided on the second end of the frame, the limit protrusion is located in the limit slot and cooperates with the limit slot to control the rotation angle of the clip board.

In some embodiments, the resistance adjustment mechanism includes a magnetic-controlled device provided on the rotation shaft of the flywheel, and the magnetic-controlled device is connected to a drive device for controlling the rotation of the rotation shaft.

In some embodiments, the rocker-rod mechanism includes two rocker rods arranged symmetrically on the frame, one end of the rocker rod is hingedly connected to the frame, an the other end of the rocker rod is hingedly connected to the other end of the link.

In some embodiments, an angle-adjustable handle is provided at one end of the rocker rod.

In some embodiments, the elliptical trainer further includes a control device provided at the first end of the frame, and the control device is electrically connected to the drive device.

The invention has the following advantages by adopting the above technical solutions: 1. Since the apparatus of the invention is provided with an adjustment mechanism which is rotatably connected to the frame and the pedal mechanism is slidably connected to the adjustment mechanism, an exercise experience that the user simulates climbing by means of the pedal mechanism can be improved by changing an elevation angle of the adjustment mechanism relative to the frame. 2. One end of the adjustment table of the apparatus of the invention is connected to the frame via a lifting mechanism, therefore the elevation angle of the adjustment table can be controlled by the lifting mechanism. 3. In the apparatus of the invention, since a sliding slot is provided on the adjustment table and one end of the support rod of the pedal mechanism is slidably connected in the sliding slot, the pedal mechanism can have different movement trajectories by adjusting the adjustment table. 4. In the apparatus of the invention, since a resistance adjustment mechanism is provided on the flywheel, the user can perform adjustment as required to increase the rotation resistance of the flywheel and the tunable, thus providing more exercise experiences for the user. 5. In the apparatus of the invention, a clip board is provided on the rotation shaft of the flywheel, a plurality of limit slots are provided on the clip board, and a plurality of limit protrusions are provided on the second end of the frame, and the limit protrusions cooperates with the limit slots, a tension pulley fitting with belt is provided on the clip board, therefore the limit of the clip board can be realized and the multi-position adjustment of the resistance adjustment mechanism can be realized, and the rotation resistance of the flywheel and the turntable can be adjusted.

6. The apparatus of the invention realizes different motion modes of the apparatus of the invention by means of the adjustment mechanism and the resistance adjustment mechanism, and provides more different movement experiences for the user.

The above summary is merely for the purpose of illustration and is not intended to be limited in any way. In addition to the aspects, embodiments and features described above, further aspects, embodiments, and features of the invention will be readily apparent from the following detailed description with reference to the accompanying drawings.

BRIEF DESCRIPTION OF THE DRAWINGS

In the drawings, the same reference numerals refer to like or similar parts or elements throughout several drawings, unless otherwise specified. These drawings are not necessarily drawn to scale. It is to be understood that these drawings only depict some embodiments according to the present disclosure and should not be construed as limiting the scope of the invention.

DETAILED DESCRIPTION

In the following, only certain exemplary embodiments are briefly described. As will be appreciated by those skilled in the art, the described embodiments may be modified in various different ways without departing from the spirit or scope of the invention. Accordingly, the drawings and description are to be regarded as being illustrative in nature and not restrictive.

In the description of the invention, it is to be understood that the orientation or positional relationship indicated by the terms "center", "longitude", "transverse", "length", "width", "thickness", "upper", "lower", "front", "behind", "left", "right", "vertical", "horizontal", "top", "bottom", "internal", "external", "clockwise", "counterclockwise" is based on the orientation or positional relationship indicated in the figures, and is merely intended to facilitate illustration of the invention and simplify the description and is not intended or implied that the devices or elements indicated must have a specific orientation and be constructed and operated in a particular orientation and therefore can not be understood as limitations to the invention. In addition, the terms "first" and "second" are merely for illustrative purposes and are not to be construed as indicating or imposing a relative importance or implicitly indicating the number of technical features indicated. Thus, a feature that is defined using "first" or "second" may expressly or implicitly include one or more the features. In the description of the invention, the meaning of "a plurality of" refers to two or more, unless otherwise specifically defined.

In the description of the invention, it is to be noted that, unless otherwise expressly specified or limited, the terms "mount," "connect", "couple" are to be broadly understood, for example, it may be fixed connection, detachable connection, or integral connection; it may be mechanical connection or electrical connection or communication with each other; it may be direct connection or indirect connection via an intermediate medium; it may be interconnection of two elements or an interaction relationship of two elements. The specific meanings of the above terms in the invention may be understood by those skilled in the art in light of the circumstances.

Figure 1:
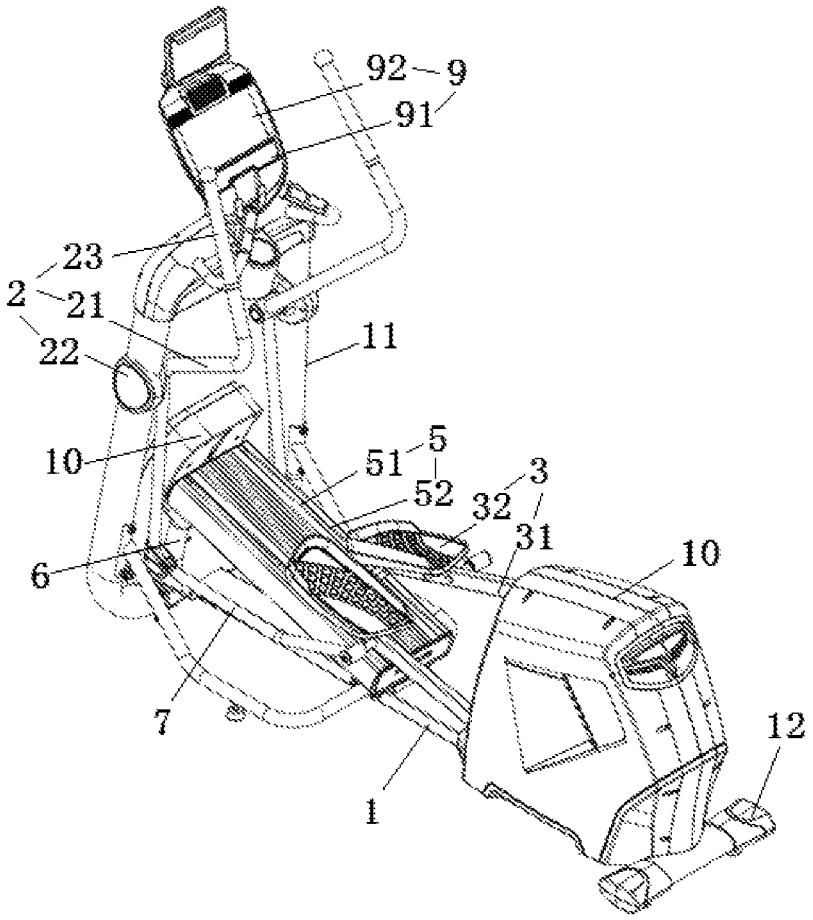
FIG. 1 is a schematic view of the overall structure of an apparatus of the invention.

Specifically, as shown in FIG. 1, the apparatus of the invention includes a frame 1 provided on the ground, the frame 1 has a first end 11 and a second end 12, a rocker-rod mechanism 2 for a user to operate with hands is hingedly connected to the first end 11 of the frame 1, a pedal mechanism 3 is provided at the second end 12 of the frame 1, the pedal mechanism 3 is hingedly connected to the second end 12 through a transmission mechanism 4 for the user's leg and foot to manipulate. An adjustment mechanism 5 is provided on the frame 1, and the adjustment mechanism 5 includes an adjustment table 51, one end of the adjustment table 51 is rotatably connected to the bottom of the frame 1 and the other end of the adjustment table 51 is connected to the frame 1 through a lifting mechanism 6, the pedal mechanism 3 is slidably connected to the adjustment table 51, and when the lifting mechanism 6 moves, the adjustment table 51 can adjust the height position of the pedal mechanism 3 relative to the frame 1 by means of the change in the elevation angle so as to satisfy difference exercise demands of a user. The apparatus further includes a link 7, and the two ends of the link 7 are hingedly connected to the pedal mechanism 3 and the rocker-rod mechanism 2 respectively so as to realize the linkage between the rocker-rod mechanism 2 and the pedal mechanism 3 so that the pedal mechanism 3 can make a movement along a substantial elliptical trajectory relative to the frame 1.

Figure 2:
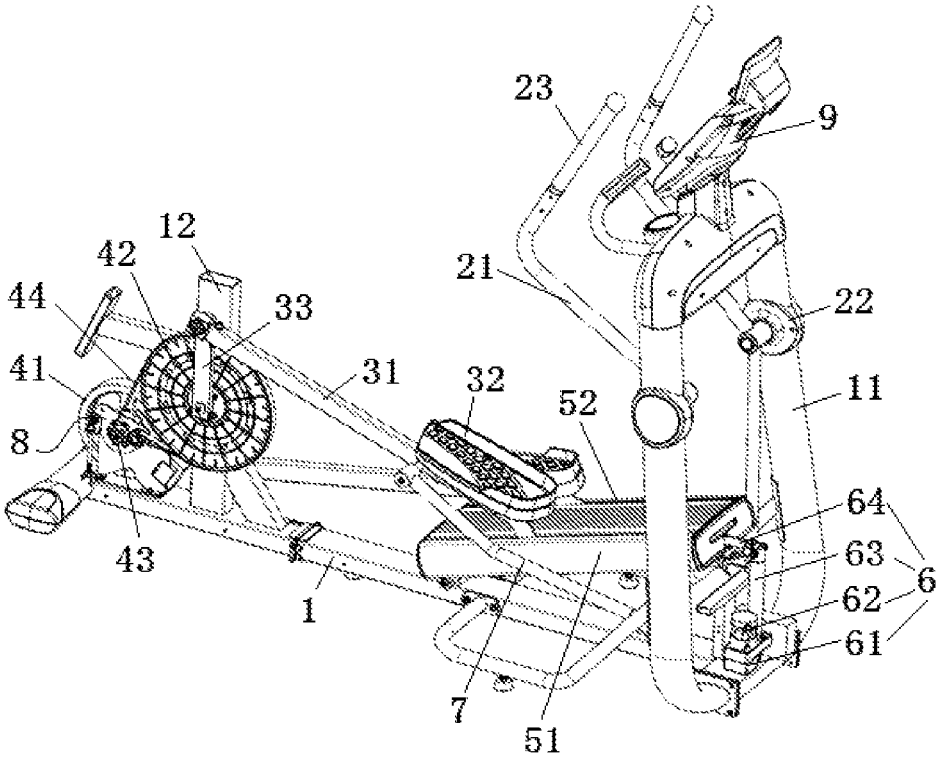
FIG. 2 is a view of the internal structure of an apparatus of the invention.

As shown in FIG. 2, the lifting mechanism 6 includes a mounting seat 61, a drive device 62 and a strut 63, the mounting seat 61 is tightly connected to the bottom of the first end 11 of the frame 1, the strut 63 is vertically provided on the mounting seat 61, the drive device 62 is provided on the mounting seat 61 at one side of the strut 63, the upper end of the strut 63 is hingedly connected to the other end of the adjustment table 51 through a connecting member 64, and the strut 63 can perform up-down reciprocating movement under the driving from the drive device 62, so as to adjust the elevation angle of the adjustment table 51 relative to the frame 1, thereby changing the position of the pedal mechanism 3 relative to the frame 1.

In a preferred embodiment, the strut 63 may employ a screw rod mechanism, the drive mechanism 62 employs an motor, the motor is connected to the screw rod mechanism by means of the drive mechanism, and when the output shaft of the motor rotates, the drive mechanism is drove to drive the screw rod to move upwardly and downwardly in a sleeve, thereby enabling the adjustment table 51 to rotate relative to the frame 1.

In a preferred embodiment, the strut 63 may employ a cylinder structure or a hydraulic cylinder structure, and perform reciprocating movement by means of a piston rod of a cylinder or a hydraulic cylinder, thereby enabling the adjustment table 51 to rotate relative to the frame 1.

As shown in FIG. 2, sliding slots 52 are provided on both sides of the adjustment table 51, and the pedal mechanism 3 includes two symmetrically arranged support rods 31 and two pedals 32 arranged on the top of the two support rods 31 respectively, one end of the support rod 31 that is close to the pedal 32 is slidably connected to the sliding slot 52, the other end of the support rod 31 is connected to a transmission mechanism 4 at the second end 12, and one end of the link 7 is hingedly connected to the support rod 31.

In a preferred embodiment, a roller structure is provided at one end of the support rod 31 and the end of the support rod 3 slides in the sliding slot 52 by means of the roller structure to achieve movement of the pedal mechanism 3 relative to the adjustment table 51, and the width of the sliding slot 52 is greater than the size of the roller structure, so that the roller structure can be detachably connected to the sliding slot 52 for easy maintenance and replacement.

In a preferred embodiment, a rotation shaft is inserted at one end of the support rod 31 and the rotation shaft is in the sliding slot 52 and is rotatably engaged with the sliding slot 52 to achieve movement of the pedal mechanism 3 relative to the adjustment table 51.

In a preferred embodiment, one end of the strut 31 directly fits with the sliding slot 52 to slide in the sliding slot 52 so as to achieve movement of the pedal mechanism 3 relative to the adjustment table 51.

As shown in FIGS. 1 and 2, the rocker-rod mechanism 2 includes two rocker rods 21 symmetrically disposed on the first end 11 of the frame 1. The upper end of the rocker rod 21 is hingedly connected to the first end of the frame 1 through a connecting member 22, and the other end of the rocker rod 21 is hingedly connected to the other end of the link 7, thereby achieving the linkage between the rocker rod 21, the link 7, the support rod 31 and the pedal 32.

In order to meet the needs of different users, a handle 23 is detachably provided at the upper end of the rocker rod 21, and the handle 23 is in a bent shape and is rotatable relative to the rocker rod 21, and can be adjusted as necessary.

Figure 3:
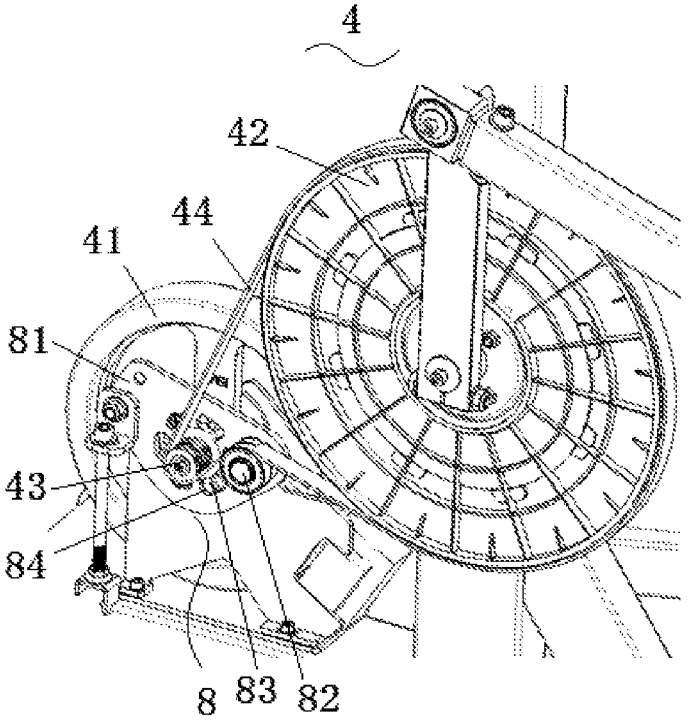
FIG. 3 is a partial enlarged view of the structure of a flywheel of the invention.

As shown in FIGS. 2 and 3, the transmission mechanism 4 includes a flywheel 41 and a turntable 42 provided at the second end 12 of the frame 1, and the flywheel 41 and the turntable 42 are respectively rotatably connected to the second end 12, wherein the flywheel 41 is rotatably connected to the second end 12 by means of a rotation shaft 43 provided at the center of the flywheel 41, and the rotation shaft 43 and the turntable 42 together support a belt 44, thereby forming a belt drive mechanism. The other end of the support rod 31 is connected to the turntable 42 so as to realize driving the turntable 42 and the flywheel 41 to rotate together when the support rod 32 moves along a substantial elliptical trajectory relative to the frame 1.

It is to be noted that the other end of the support rod 31 can be rotatably connected to an end face of the turntable 42 at one side directly so that the turntable 42 can be rotated with the support rod 31, or the support rod 31 is connected to the turntable 42 through an auxiliary link 33, one end of the auxiliary link 33 is hingedly connected to the other end of the support rod 31, and the other end of the auxiliary link 33 is fixedly connected to the center of the turntable 42 so that the auxiliary link 33 can drive the support rod 31 to move when the turntable 42 is rotated.

In order to improve the user experience and satisfy the different exercise strength requirements of the user, the flywheel 41 may be provided with a resistance adjustment mechanism 8 for changing the rotation resistance of the flywheel 41.

In a preferred embodiment, as shown in FIGS. 2 and 3, the resistance adjustment mechanism 8 includes a clip board 81 sleeved on the rotation shaft 43, and the clip board 81 is rotatably connected to the rotation shaft 43, and a tension pulley 82 is provided on the clip board 81, the tension pulley 82 is in contact with a belt 44 for adjusting the tension of the belt 44 to change the resistance to the rotation of the flywheel 41 drove by rotation shaft 43. The clip board 81 is connected to a drive device for controlling the rotation of the clip board 81 relative to the rotation shaft 43.

It is to be noted that, in order to control the rotational angle of the clip board 81, a plurality of limit slots 84 may be provided on the clip board 81 in the circumferential direction, and a plurality of limit protrusions 83 fitting with the plurality of limit slots 84 are provided on the second end 12 of the frame 1. The limit protrusion 83 is located in the limit slot 84. When the clip board 81 is rotated, the limit slot 84 is rotated with the clip board 81, and when the limit slot 84 comes into contact with the limit protrusion 83, the clip board 81 is stopped, thereby achieving a limit to the clip board 81. When the clip board 81 is rotated counterclockwise, the tension pulley 82 moves with the clip board 81 and tensions the belt 44 to increase rotation resistance of the flywheel 41; when the clip board 81 is rotated clockwise, the tension pulley 82 moves with the clip board 81 to loosen and the belt 44 to reduce rotation resistance of the flywheel 41. On the contrary, depending on the position of the tension pulley 82, it may be the following situation: the tension pulley 82 loosens the belt 44 when the clip board 81 is rotated counterclockwise, and the tension pulley 82 tensions the belt when the clip board 81 is rotated clockwise. By tensioning or loosening the belt 44, the rotation resistance of the turntable 42 is controlled so that the user's leg and foot are subjected to a different degree of difficulty of exercise experience.

In another preferred embodiment, the resistance adjustment mechanism 8 includes a magnetic-controlled device (not shown) provided on the rotation shaft 43, the magnetic-controlled device is connected to a drive device, the rotation resistance of the rotation shaft 43 is adjusted by the magnetic force supplied to the magnetic-controlled device by the drive device so that the user's leg and foot are subjected to a different degree of difficulty of exercise experience.

As shown in FIGS. 1 and 2, the apparatus of the invention further includes a control system 9 provided at the upper portion of the first end 11 of the frame 1. The control system 9 includes a control panel 91 and a display screen 92, and is electrically connected to the drive device 62 of the lifting mechanism 6 and the drive device of the resistance adjustment mechanism 8. The user controls and adjusts the power provided by each drive device through the control panel 91, thereby adjusting the elevation angle of the adjustment table 51 and different movement resistance obtained when the user manipulates the pedal 32, and the user can individually adjust according to the real-time data displayed on the display screen 92.

In the above embodiment, a casing 10 is provided at the first end 11 and the second end 12 of the frame 1, and the casing 10 covers outside of the lifting mechanism 6 and the transmission mechanism 4 for protecting the devices from being damaged.

When the apparatus of the invention is in operation, the user steps on the pedal 32 with two feet and holds the rocker rod 21 with two hands, and by the forces provided by the legs and feet, the front end of the support rod 31 at the bottom of the pedal 32 perform reciprocating movement on the adjustment table 51. When the pedal 32 moves, the support rod 32 moves with the pedal 32. At this time, the other end of the support rod 31 drives the turntable 42 and the flywheel 41 to rotate clockwise, and the hand controlled rocker rod 21 performs the front and rear movement with the pedal 32 performing the front and rear movement, the rocker rod 21, the support rod 31 and the link 7 are linked with each other to realize the synchronized movement of the user's hands and feet. When the user needs to increase the exercise intensity, the required movement resistance can be adjusted by the control panel 91. At this time, the drive device controls the resistance adjustment mechanism 8 to increase the rotational difficulty of the turntable 42 and the flywheel 41, and the user needs to provide a greater power to achieve the smooth movement of the pedal 32. At the same time, the user can also adjust the elevation angle of the adjustment table 51 according to the control panel 91. When the evaluation angle of the lifting table 51 is greater, the weight bearing on the user's leg is greater, thereby increasing the exercise intensity of the user to meet the different movement needs of the user.

The foregoing are merely specific embodiments of the invention, but the scope of the invention is not to be limited thereto. The person skilled in the art can easily conceive various changes or replacements within the scope of the invention as disclosed, and these change or replacements are to be contained within the scope of the invention. Accordingly, the scope of protection of the invention should be based on the scope of protection of the claims.

What is claimed is:

1. An elliptical trainer, comprising:

a frame having a first end and a second end;

a rocker-rod mechanism hingedly connected to the first end of the frame;

a pedal mechanism hingedly connected to the second end of the frame through a transmission mechanism;

an adjustment mechanism comprising an adjustment table, one end of the adjustment table being rotatably connected to the frame, the pedal mechanism being slidably connected to the adjustment table, the adjustment mechanism adjusting a position of the pedal mechanism relative to the frame;

a link, two ends of which are connected to the rocker-rod mechanism and the pedal mechanism respectively so that the rocker-rod mechanism is linked with the pedal mechanism;

wherein the transmission mechanism comprises a turntable and a flywheel respectively rotatably connected to the second end of the frame, a rotation shaft of the flywheel is connected to the turntable through a belt; and a resistance adjustment mechanism, provided on the flywheel, configured to change a rotation resistance of the flywheel;

the resistance adjustment mechanism comprises a clip board sleeved on the rotation shaft of the flywheel and rotatably connected to the rotation shaft, a tension pulley is provided on the clip board, the tension pulley adjusting the tension of the belt to change the resistance to the rotation of the flywheel.

2. The elliptical trainer according to claim 1, wherein a sliding slot is provided on the adjustment table.

3. The elliptical trainer according to claim 2, wherein the pedal mechanism comprises two support rods and two pedals provided an the two support rods respectively, one end of the support rod that is close to the pedal is slidably connected to the sliding slot, another end of the support rod is connected to the transmission mechanism, and one end of the link is hingedly connected to the support rod.

4. The elliptical trainer according to claim 3, wherein the other end of the support rod is connected to the turntable.

5. The elliptical trainer according to claim 4, wherein a plurality of limit slots are provided on the clip board, a plurality of limit protrusions are provided on the second end of the frame, the limit protrusion is located in the limit slot and cooperates with the limit slot to control the rotation angle of the clip board.

6. The elliptical trainer according to claim 1, wherein the rocker-rod mechanism comprises two rocker rods arranged symmetrically on the frame, one end of the rocker rod is hingedly connected to the frame, and another end of the rocker rod is hingedly connected to another end of the link.

7. The elliptical trainer according to claim 6, wherein an angle-adjustable handle is provided at one end of the rocker rod.

8. The elliptical trainer according to claim 1, wherein another end of the adjustment table is connected to a lifting mechanism comprising a strut and a drive device configured to drive the strut to extend or retract, and one end of the strut is hingedly connected, to the other end of the adjustment table configured to adjust a slope of the adjustment table and a position of the pedal mechanism.

9. The elliptical trainer according to claim 1, further comprising a control device provided at the first end of the frame, which is electrically connected to the drive device.

* * * * *